US012655972B1

(12) United States Patent
Boys

(10) Patent No.: US 12,655,972 B1
(45) Date of Patent: Jun. 16, 2026

(54) FLARE FOR MINE GAS COMBUSTION OPERATIONS

(71) Applicant: Edward T. Boys, Pomona, MO (US)

(72) Inventor: Edward T. Boys, Pomona, MO (US)

( * ) Notice: Subject to any disclaimer, the term of this patent is extended or adjusted under 35 U.S.C. 154(b) by 557 days.

(21) Appl. No.: 18/052,622

(22) Filed: Nov. 4, 2022

Related U.S. Application Data

(60) Provisional application No. 63/275,558, filed on Nov. 4, 2021.

(51) Int. Cl.
*F23G 7/08* (2006.01)

(52) U.S. Cl.
CPC ..... *F23G 7/08* (2013.01)

(58) Field of Classification Search
CPC ..... F23G 7/08; F23G 7/085; F23G 7/06
USPC ..... 431/5, 202
See application file for complete search history.

(56) References Cited

U.S. PATENT DOCUMENTS 3,807,940 A * 4/1974 Juricek ..... B01F 25/311 431/351
4,895,085 A * 1/1990 Chips ..... B09C 1/005 110/236
4,900,244 A * 2/1990 Keller ..... F23G 7/08 431/328
5,295,817 A * 3/1994 Young ..... F23C 6/047 431/207
5,360,335 A 11/1994 Anderson ..... F23N 1/002
2013/0133405 A1 * 5/2013 Al-Buaijan ..... F15B 19/005 73/37
2013/0167550 A1 7/2013 Snider ..... F01D 19/00
2016/0305662 A1 10/2016 Nakata ..... F23C 3/002
2019/0203933 A1 * 7/2019 Khan ..... F23G 7/065

OTHER PUBLICATIONS

Sies et. al (Sies, M. Wahid, M. "Numerical Investigation of the Asymmetrical Vortex Combustor Running on Biogas". Journal of Advanced Research in Fluid Mechanics and Thermal Sciences. Aug. 2020.).*
Ignition Temperature of Materials. https://www.tayloredge.com/reference/Science/ignition.html.*
Honeywell RM7897A relay module brochure (Year: 2018).
Honeywell RM7800E Relay module installation instructions (Year: 2022).

* cited by examiner

*Primary Examiner* — Vivek K Shirsat
(74) *Attorney, Agent, or Firm* — Jonathan Bay

(57) ABSTRACT

A flare is disclosed for mine gas combustion operations. The flare is nominally eight feet six inches in diameter and thirty-seven feet tall, and is constructed with two concentric steel shells (ie., an inner and an outer shell) that are insulated with ceramic fiber. The inner shell functions as the combustion chamber which operates nominally between 1600° F. (~870° C.) and 2,000° F. (~1,093° C.). Thermocouples also provide over-temperature protection if the combustion process exceeds 2,000° F. (~1,093° C.). The outer shell uses 'stack effect(s)' to induce a natural draft of quench air that will mix with the combustion products to cool the final discharge of the flare (ie., the mixture of the quench air and combustion products) to a sub 1,000° F. (~538° C.) discharge temperature.

16 Claims, 1 Drawing Sheet

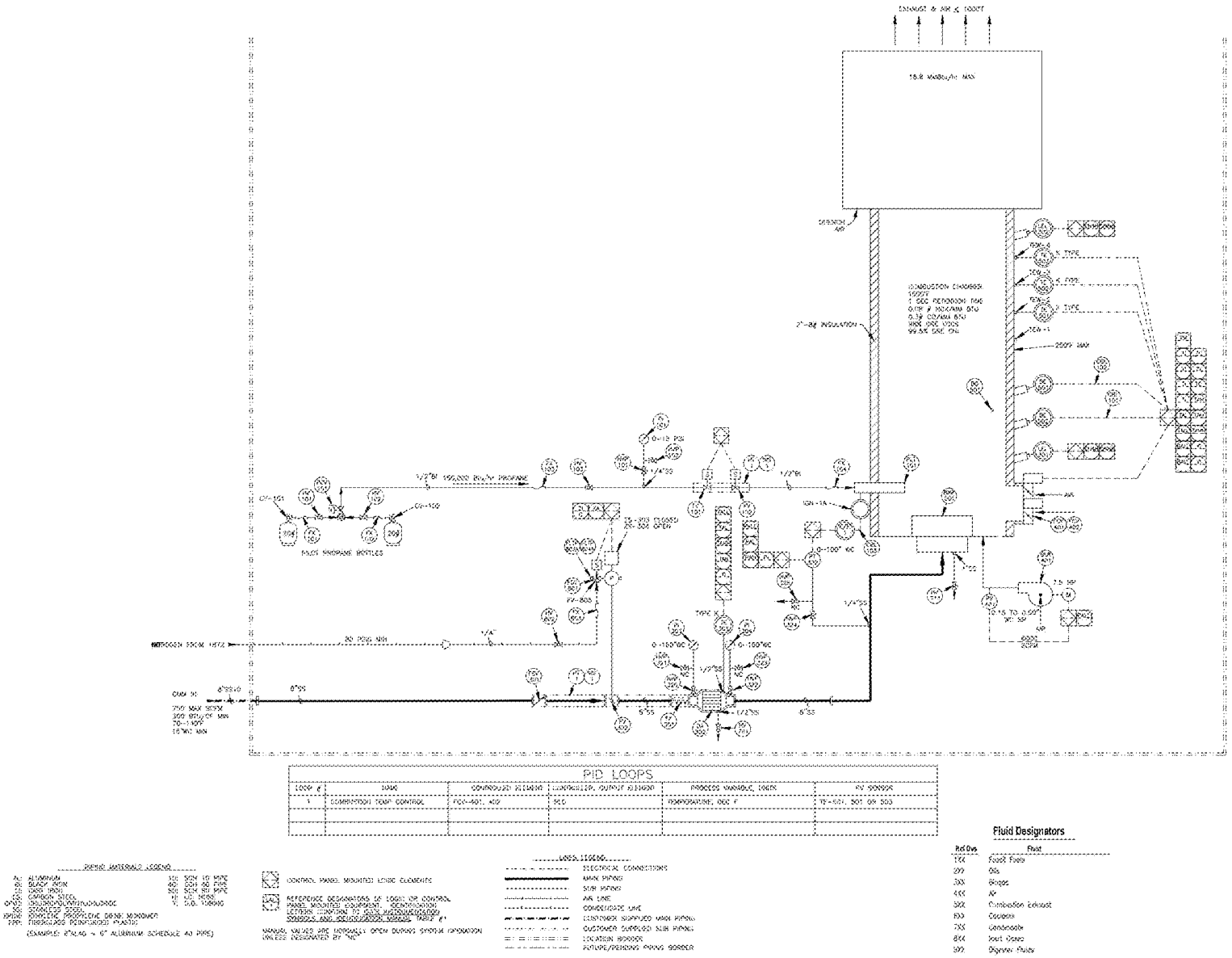
PID LOOPS
Fluid Designators
Ref Des
Fluid Name
Gas
Steam
Air
Combustion Exhaust
Coolant
Condensate
Hot Fluid
Process Fluids

FLARE FOR MINE GAS COMBUSTION OPERATIONS

CROSS-REFERENCE TO PROVISIONAL APPLICATION(S)

This application claims the benefit of U.S. Provisional Application No. 63/275,558, filed Nov. 4, 2021. The foregoing patent disclosure(s) is (are) incorporated herein by this reference thereto.

BACKGROUND AND SUMMARY OF THE INVENTION

The invention relates to mine gas flaring operations and, more particularly, to improvements in a flare as well as electric power systems, manual control systems, automatic electronic control systems, telecommunications, process and flow connections and systems and the like in the operation thereof.

It is an object of the invention to safely combust mine gas in a flare which has been moved from existing mine bore holes or mine vents to the flare.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings, The sole FIGURE is a schematic diagram of a flare in accordance with the invention, and perhaps some of the supporting (attending) electric power systems, manual control systems, automatic electronic control systems, telecommunication devices, process and flow connections and systems (and more) for combusting mine gas.

DETAILED DESCRIPTION OF THE PREFERRED EMBODIMENTS

With reference to sole FIGURE, an overview of functional and operational matters for the flare apparatus in accordance with the invention for combusting mine gas include the following.

The principal purpose of the flare apparatus in accordance with the invention for combusting mine gas is to, safely combust mine gas. The flare apparatus includes at its functional and operational core, a flare. The flare is located ten feet from a Gas Skid, and the flare is connected with an eight inch diameter Schedule 10 pipe of 304 Stainless Steel. The devices on the flare are connected to a control panel located on the Gas skid.

The flare is nominally 102 inches in diameter (eight feet six inches, or ~2.59 m) and 37 feet tall (~11.28 m), and is constructed with two concentric steel shells (ie., an inner shell and an outer shell) that are insulated with ceramic fiber. The inner shell functions as the combustion chamber. The outer shell uses 'stack effect(s)' to induce a natural draft of quench air that will mix with the combustion products to cool the final discharge of the flare (ie., the mixture of the quench air and combustion products) to a sub 1,000° F. (~538° C.) discharge temperature.

The Gas Skid is disposed proximate a mine vent or other outlet where mine gas can be drawn out (or recovered and so on). The Gas Skid carries a Gas Blower. The Piping network and Valve Train between the Gas Blower and Flare include the following.

Mine Gas flows to the flare from the Gas Skid through the eight inch pipe, and a flare check valve (FSV-301) ensures that air is not pulled back into the flare network. A pneumatically operated API 607 fire safe high performance butterfly valve (FV-302) is used for a safety shutoff valve It is equipped with a visual beacon and with supervisory switches that monitor valve position (ZS-303—closed, ZS-304—open). The switches are in an enclosure rated for Class 1 Division 1 Group D locations. The solenoid Valve is rated for Class 1 Division 1 Group D locations. Dry compressed nitrogen, supplied by two gas bottles, is used to actuate this valve. In event of power or nitrogen loss, the flare shutdown valve fails closed. The check valve and shutdown valve are heat traced and insulated to ensure that they will not freeze and fail. The self regulating heating cable is approved for use in Class 1 Division 1 Group D locations.

A stainless steel bellows (FX-30X) is used between the safety shutoff valve and detonation arrestor. This bellows allows for thermal growth and for vibration isolation.

Detonation Arrestor (DA-302) bolts to the flange on the burner manifold. Thermocouple (TE-303) monitors the temperature on the flare side of the thermocouple a programmable logic controller ("PLC") is hard coded to shutdown the flare and blower if the temperature exceeds 200° F. (~93° C.) or if the thermocouple fails.

Pressure Transducer (PT-302) monitors the gas pressure at the burner manifold.

Manifold pressure is a surrogate for (eg., a calculated correlative dependent on) gas exit velocity. The intent is that the gas exit velocity is sufficiently high to ensure that flashback does not occur during operation. Note that this system also has flow measurement as a second safety against low flow rates.

Aspects of the Combustion Chamber for the flare include the following.

The burner (BNR-501) uses staged fuel to lower the production of oxides of nitrogen ("NOX"). The burner is located inside a combustion chamber that operates at nominally 1600° F. (~870° C.) with a 1 second retention time. The exit temperature from the flare is controlled by a staged quench as cold air, drawn from near the ground, is introduced into the combustion products after the combustion process is complete. The combustion temperature is controlled by two air dampers (FV-401, -402). Thermocouples (TE-501, -502, & -503) through the side of the combustion chamber measure the process temperatures, and the PLC modulates the damper position to control temperature: ie., more air equals a colder temperature. These thermocouples also provide over-temperature protection if the combustion process exceeds 2,000° F. (~1,093° C.).

The combustion chamber is lined with ceramic insulation retained by INCONEL® steel pins. A rigidizer is applied to the face of the insulation to increase resistance to erosion due to gas velocity.

When the flare is not running, the dampers are fully open to vent any residual or accumulated vapors from the chamber. At start up, the dampers close and a purge blower (BLR-401) moves eight volumes of air through the combustion chamber prior to lighting the pilot. The purge blower has a 5 HP totally-enclosed fan-cooled ("TEFC") 480 VAC electric motor. Pressure switch (PS-401) is used to prove the purge blower. The purge blower motor is labeled for use in a Class 1 Division 2 Group D location. The pressure switch is labeled for use in a Class 1 Division 1 Group D location.

The propane pilot (PLT-101) has dual block solenoids (FV-101, -102). The propane pilot is spark ignited by ignition transformer (E/E-1). Solenoids (FV-101 and FV-102) are labeled for use on fuel gas in a Class 1 Division 1 Group D location, and are heat traced and insulated with the same self regulating tape previously described.

Two self checking UV Flame detectors (BE-501 & 502) are used to monitor the flame in the combustion chamber. These are wired to the Burner Controller (BS-1) located in the control panel mounted on the Gas Blower Skid.

A site glass (BG-501) is provided to observe the pilot and burners.

A manway (nominally 36 inches by 36 inches, or approximately ~1 m by ~1 m) provides access to the combustion chamber.

In regards of a Quench Chamber, it comprises an outer steel chamber that surrounds the combustion chamber. The Quench Chamber draws air from nominally five foot (~1.5 M) above grade and conveys it to the discharge of the combustion chamber. There, quench air draw mixes with the exhaust gasses (combustion gases), and mixes to cool the mixture to less than 1,000° F. (~538° C.).

A ladder with a fall safety system is provided to access the thermocouples (TE-501, -502 & -503).

Two sensors are provided for sensing when a mixture of air and a combustible vapor(s) (fuel) exceed, reach or dip below a 'lower explosive limit' ("LEL") therefor (sensors LEL-301, -302). One LEL sensor is located about four foot (~1.22 m) above grade to monitor the air coming into the combustion air dampers and quench chamber, the second LEL sensor is located on the side of the quench chamber approximately five feet (~1.5 m) below the top. The LEL sensors are approved for use in a Class 1 Division 1 Group D location.

As for grounding and bonding, the flare is grounded. Two Ground pads are provided on the flare, these will be connected on site to a 5 Ohm or less ground. Grounding & bonding conform to the 2020 edition of NFPA 780, Standard for the Installation of Lightning Protection Systems (National Fire Protection Association).

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed:

1. A flare system for waste gas combustion operations; said flare system comprising:

a stack-like shell defining a combustion chamber and configured to confine a flare for combustion of waste gas and exhaust the combustion products out of the combustion chamber;

a blower for blowing waste gas whereby collected from a ground bore hole or vent;

said blower configured to blow waste gas to the shell through a main piping network and valve train;

a programmable logic controller (PLC);

wherein the programmable logic controller is configured and operated such that combustion in the combustion chamber is adapted to take place between a lower combustion-temperature limit and an upper combustion-temperature limit;

wherein the main piping network and valve train includes a pneumatically-operated, safety, flare shutdown valve (FV-302); and further comprising a source of a pressurized inert gas connected to operate the pneumatically-operated flare shutdown valve (FV-302).

2. The flare system of claim 1, further comprising:

a thermocouple (TE-501, TE-502 and/or TE-503) associated with the combustion chamber to provide the programmable logic controller with temperature sensing of the combustion temperature including over-temperature sensing if combustion temperature exceeds the upper combustion-temperature limit; and an air damper (FCV-401 or FCV-402) associated with the side of the shell that is controlled by the programmable logic controller to modulate, according to at least in part thermocouple sensing, damper position, and thereby control combustion temperature.

3. The flair system of claim 1 wherein:

the lower combustion-temperature limit and upper combustion-temperature limit are 1600° F. (~870° C.) and 2,000° F. (~1,093° C.) respectively.

4. The flair system of claim 1, wherein:

the pneumatically-operated flare shutdown valve (FV-302) is configured such that in event of power or inert gas loss, the flare shutdown valve (FV-302) fails closed.

5. The flair system of claim 1, wherein:

the programmable logic controller is configured to control at least in part the pneumatically-operated safety shutdown valve (FV-302).

6. The flair system of claim 5, wherein:

the main piping network and valve train further includes a detonation arrestor (DA-302) between the flare shutdown valve (FV-302) and flare combustion chamber.

7. The flair system of claim 6, further comprising:

a thermocouple (TE-303) monitoring temperature on the flare side of detonation arrestor (DA-302);

wherein the programmable logic controller is further configured to shutdown the flare if the temperature exceeds a selected temperature limit.

8. The flair system of claim 7, further comprising:

an air damper (FCV-401 or FCV-402) associated with the side of the shell that is controlled by the programmable logic controller to modulate damper position, and thereby control combustion temperature; and wherein the programmable logic controller shuts down the flare by any or all of the flare shutdown valve, the air damper and/or the blower.

9. A flare system for waste gas combustion operations; said flare system comprising:

a stack-like shell defining a combustion chamber and configured to confine a flare for combustion of waste gas and exhaust the combustion products out of the combustion chamber;

a blower for blowing waste gas whereby collected from a ground bore hole or vent;

said blower configured to blow waste gas to the shell through a main piping network and valve train;

a programmable logic controller (PLC);

wherein the programmable logic controller is configured and operated such that combustion in the combustion chamber is adapted to take place between a lower combustion-temperature limit and an upper combustion-temperature limit; and further comprising a pair of 'lower explosive limit' ("LEL") sensors (LEL-301 and LEL-302) provided for sensing when a mixture of air and a combustible vapor(s) (fuel) exceed, reach or dip below a 'lower explosive limit' therefor;

one LEL sensor being associated with the shell/combustion chamber proximate a low elevation whereby proximate a burner;

the other LEL sensor being associated with the shell/combustion chamber proximate a high elevation whereby proximate exhaustion of combustion products; and an air damper (FCV-401 or FCV-402) in the side of the shell that is controlled by the programmable logic controller to modulate, according at least in part to LEL sensing, damper position.

10. The flair system of claim 9, further comprising:

a pair of UV Flame detectors (BE-501 & 502) provided to monitor the flame in the combustion chamber whereby wired to the programmable logic controller.

11. A flare system for waste gas combustion operations; said flare system comprising:

a stack-like shell defining a combustion chamber and configured to confine a flare for combustion of waste gas and exhaust the combustion products out of the combustion chamber;

a blower for blowing waste gas whereby collected from a ground bore hole or vent;

said blower configured to blow waste gas to the shell through a main piping network and valve train;

wherein the main piping network and valve train includes a pneumatically-operated, safety, flare shutdown valve (FV-302); and further comprising a source of a pressurized inert gas connected to operate the pneumatically-operated flare shutdown valve (FV-302).

12. The flair system of claim 11, further comprising:

further comprising a programmable logic controller (PLC) that is configured to control at least in part the pneumatically-operated safety shutdown valve (FV-302); and further comprising any of:

a thermocouple (TE-501, TE-502 and/or TE-503) associated with the combustion chamber to provide the programmable logic controller with temperature sensing of the combustion temperature including over-temperature sensing if combustion process temperature exceeds an upper combustion-temperature limit, and a thermocouple (TE-303) monitoring temperature anywhere on the main piping network and valve train on the flare side of the shutdown valve (FV-302) to provide the programmable logic controller with temperature sensing of the main piping network and valve train on the flare side of the shutdown valve (FV-302) including over-temperature sensing in excess of a selected temperature limit, wherein the programmable logic controller is further configured to shutdown the flare in part by the pneumatically-operated safety shutdown valve (FV-302) whereby according to if any of the temperature limits have been exceeded.

13. The flair system of claim 12, further comprising:

an air damper (FCV-401 or FCV-402) associated with the side of the shell that is controlled by the programmable logic controller to modulate damper position, and thereby control combustion temperature; and wherein the programmable logic controller shuts down the flare by any or all of the flare shutdown valve, the air damper and/or the blower.

14. A flare system for waste gas combustion operations; said flare system comprising:

a stack-like shell defining a combustion chamber and configured to confine a flare for combustion of waste gas and exhaust the combustion products out of the combustion chamber;

a blower for blowing waste gas whereby collected from a ground bore hole or vent;

said blower configured to blow waste gas to the shell through a main piping network and valve train;

wherein the main piping network and valve train includes a detonation arrestor (DA-302); and further comprising a programmable logic controller (PLC) that is configured to control at least in part the detonation arrestor (DA-302); and further comprising any of:

a thermocouple (TE-501, TE-502 and/or TE-503) associated with the combustion chamber to provide the programmable logic controller with temperature sensing of the combustion temperature including over-temperature sensing if combustion process temperature exceeds an upper combustion-temperature limit, and a thermocouple (TE-303) monitoring temperature on the flare side of the detonation arrestor (DA-302) to provide the programmable logic controller with temperature sensing of the main piping network and valve train on the flare side of the detonation arrestor (DA-302) including over-temperature sensing in excess of a selected temperature limit, wherein the programmable logic controller is further configured to shutdown the flare in part by the blower whereby according to if any of the temperature limits have been exceeded.

15. The flair system of claim 14, further comprising:

an air damper (FCV-401 or FCV-402) associated with the side of the shell that is controlled by the programmable logic controller to modulate damper position, and thereby control combustion temperature; and wherein the programmable logic controller shuts down the flare by any or both of the air damper and/or the blower.

16. The flair system of claim 15, further comprising:

a pair of 'lower explosive limit' ("LEL") sensors (LEL-301 and LEL-302) provided for sensing when a mixture of air and a combustible vapor(s) (fuel) exceed, reach or dip below a 'lower explosive limit' therefor;

one LEL sensor being associated with the shell/combustion chamber proximate a low elevation whereby proximate a burner;

the other LEL sensor being associated with the shell/combustion chamber proximate a high elevation whereby proximate exhaustion of combustion products; and wherein the air damper (FCV-401 or FCV-402) in the side of the shell is controlled by the programmable logic controller to modulate, according at least in part to LEL sensing, damper position.

* * * * *